US005518045A

United States Patent [19]

Clements et al.

[11] Patent Number: 5,518,045

[45] Date of Patent: May 21, 1996

[54] TWIST TIE MACHINE

[75] Inventors: Steven D. Clements, Nanuet, N.Y.; Thomas O. Jacobsen, Midland Park, N.J.

[73] Assignee: Ben Clements & Sons, Inc., South Hackensack, N.J.

[21] Appl. No.: 339,148

[22] Filed: Nov. 14, 1994

[51] Int. Cl.[6] ..... B21F 15/04

[52] U.S. Cl. ..... 140/119; 140/93 A

[58] Field of Search ..... 140/54, 57, 93 A, 140/119, 115

[56] References Cited

U.S. PATENT DOCUMENTS

| | | | |
|---|---|---|---|
| 3,318,230 | 5/1967 | Hilton . | |
| 3,369,573 | 2/1968 | Baker et al. | 140/119 |
| 3,428,096 | 2/1969 | Krylov et al. . | |
| 3,538,960 | 11/1970 | Tetrick | 140/93 A |
| 3,898,924 | 8/1975 | Mead et al. . | |
| 4,177,842 | 12/1979 | Dilley . | |
| 4,559,977 | 12/1985 | Dilley . | |
| 4,655,264 | 4/1987 | Dilley . | |
| 4,827,991 | 5/1989 | Jacobsen et al. . | |
| 4,865,087 | 9/1989 | Geiger | 140/119 |
| 4,971,238 | 11/1990 | Furutsu . | |
| 5,121,682 | 6/1992 | Parker et al. . | |

*Primary Examiner*—Lowell A. Larson
*Attorney, Agent, or Firm*—Stroock & Stroock & Lavan

[57] ABSTRACT

A twist tie device for twisting together the ends of the tie ribbon and encircling an article which is positioned therein for tying is provided. The device includes a feed element for feeding the tie ribbon in the device to the article. An arm is provided for guilding the tie ribbon around the article. A twist head, connected to a rod, is provided for tightening the tie ribbon around the article. A gear assembly is provided for rotating and driving the twist head and for driving tie ribbon feed element. A cylinder with a rod plunger, forming an actuator, is coupled to the gear assembly. In response to a control signal, the actuator moves in a first direction between a start position, a first position and a second position. When the actuator moves from a start position to a first position, it makes contact with the arm so that the arm partially wraps the tie ribbon around the article. The actuator then moves to a second position and drives the gear assembly so that the twist head tightens the tie ribbon around the article. The actuator then returns to a start position driving the gearing assembly to feed the ribbon in the device for a next twisting cycle. The twist tie device is easy to handle, light weight, portable, simple in construction and easy to clean.

17 Claims, 6 Drawing Sheets

TWIST TIE MACHINE

BACKGROUND OF THE INVENTION

This invention relates generally to a twist tie machine, and in particular, to a hand held twist tie machine capable of sealing plastic bags in boxes or drums.

Many operational steps are required to apply a twist tie in the form of a wire/paper/plastic ribbon. In the past, complex machinery has been designed to effect performance. These machines, as illustrated for example, in U.S. Pat. Nos. 3,318,230 issued May 9, 1967; 3,428,096 issued Feb. 18, 1969; 3,898,924 issued Aug. 12, 1975 and 4,177,842 issued Dec. 11, 1979, are machine constructions which rely on complex mechanisms, electrically driven in some instances, and generally using cam devices to provide sequential motions necessary to the procedural steps in applying a twist tie ribbon to the product. Such progressive patent teaches an improvement in performance and simplification in structure. However, endless belt chain drives, pulleys, complicated linkage systems are not uncommon and the need for adjustment for operation and to compensate for temperature variation and for wear is relatively frequent. Use of both a forward feed drive for the ribbon and independent reverse feed drive for tightening the ribbon above the bundle is also disclosed in the prior art, adding to its complexity.

It is also known from U.S. Pat. No. 4,559,977 issued Dec. 24, 1985 to provide a pneumatic twist tie feed device for providing a helical wrap about a package. U.S. Pat. Nos. 4,655,264; 4,827,991; and 5,121,682, owned by the Assignee, Clements Industries, Inc. of the present invention, are all directed to various improvements of these twist tie feed devices. However, each improvement, although in some cases directed to the pneumatics of the device, is directed to a complex and oversized machine.

The prior art devices are satisfactory and provide many uses in the industry, but each of the devices is overly complex and, as a result, large in size, thereby requiring a great number of controls and several pneumatic valves and solenoids. Additionally, because the prior art machines are large, none of them provide a portable device which is capable of sealing, for example, a bag in a box or a drum. These devices are configured such that they are unable to fit into a tight compartment. Rather, the item to be tied must be brought to the twist tying machine.

Accordingly, it is desirable to provide an improved twist tie device which is easier to handle, light weight and portable. The twist tie device should also be simple in mechanical construction and easy to clean.

SUMMARY OF THE INVENTION

Generally speaking, a twist tie device for twisting together the ends of the tie ribbon and encircling an article which is positioned therein for tying is provided. The device includes a feed element for feeding the tie ribbon in the device to the article. An arm is provided for guilding the tie ribbon around the article. A twist head, connected to a rod, is provided for tightening the tie ribbon around the article. A gear assembly is provided for rotating and driving the twist head and for driving tie ribbon feed element. A cylinder with a rod plunger, forming an actuator, is coupled to the gear assembly. In response to a control signal, the actuator moves in a first direction between a start position, a first position and a second position. When the actuator moves from a start position to a first position, it makes contact with the arm so that the arm partially wraps the tie ribbon around the article. The actuator then moves to a second position and drives the gear assembly so that the twist head tightens the tie ribbon around the article. The actuator then returns to a start position driving the gearing assembly to feed the ribbon in the device for a next twisting cycle.

Accordingly, it is an object of the invention to provide an improved twist tie device.

A further object of the invention is to provide an improved twist tie device that is easier to handle.

Yet another object of the invention is to provide an improved twist tie machine that is simple in construction and reliable in operation.

Another object of this invention is to provide an improved twist tie machine that has a minimum number of parts, is simple to construct and requires little maintenance.

A further object of this invention is to provide an improved twist tie device that is portable.

Yet another object of the invention is to provide an improved twist tie device that enables the user to seal bags and the like in tight positions.

A yet further object of the invention is to provide a twist tie device that can withstand most forms of cleaning that meet today's food packaging standards including steam cleaning.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
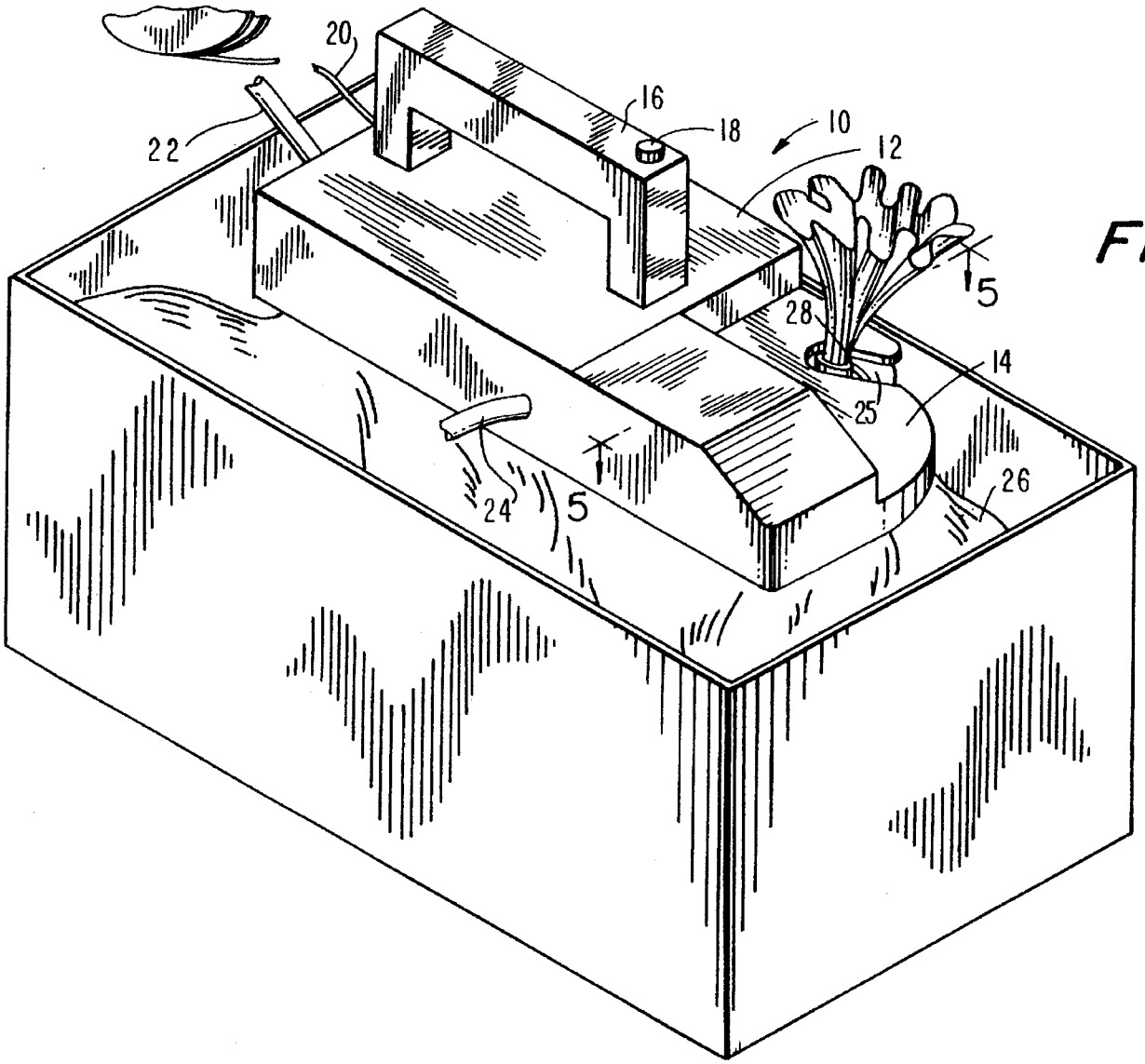
FIG. 1 is a perspective view of the twist tie device constructed and used in accordance with the invention.

Referring to FIG. 1, a portable twist tie machine, generally indicated at 10, and constructed in accordance with the preferred embodiment of the invention is disclosed. Machine 10 includes a body cover 12 and a nose cover 14. A handle 16 is mounted on body cover 12 and includes an actuation button 18. Air tubes 22 and 24 for driving a pneumatic cylinder 30 (FIG. 2), as will be disclosed in greater detail below, are coupled through body cover 12 to cylinder 30. However, air tubes 22 and 24 may be connected through body cover 12 at any point of the machine so long as they couple to cylinder 30.

Tie ribbon 20 enters machine 10 at the back of body cover 12. In an exemplary embodiment, tie ribbon 20 is a paper or plastic ribbon 5/32 inches wide surrounding a 27 gauge wire. However, a non-metallic twist tie may be used as well as ribbons of different widths and gauges. Moreover, tie ribbon 20 may enter machine 10 at any point of the machine.

Nose cover 14 includes a bag receiving section 25 for receiving a bag 26 to be tied. Alternatives to bag 26 include bundles, hanks, coils, bags in boxes or drums, wire harnessing and the like for applications such as food products, explosive proof bags and agriculture storage. An untied bag 26 is inserted into bag receiving section 25, button 18 is depressed to initiate a control signal to actuate machine 10 to wrap a twist tie 28 about bag 26 as will be described below in greater detail.

Figure 2:
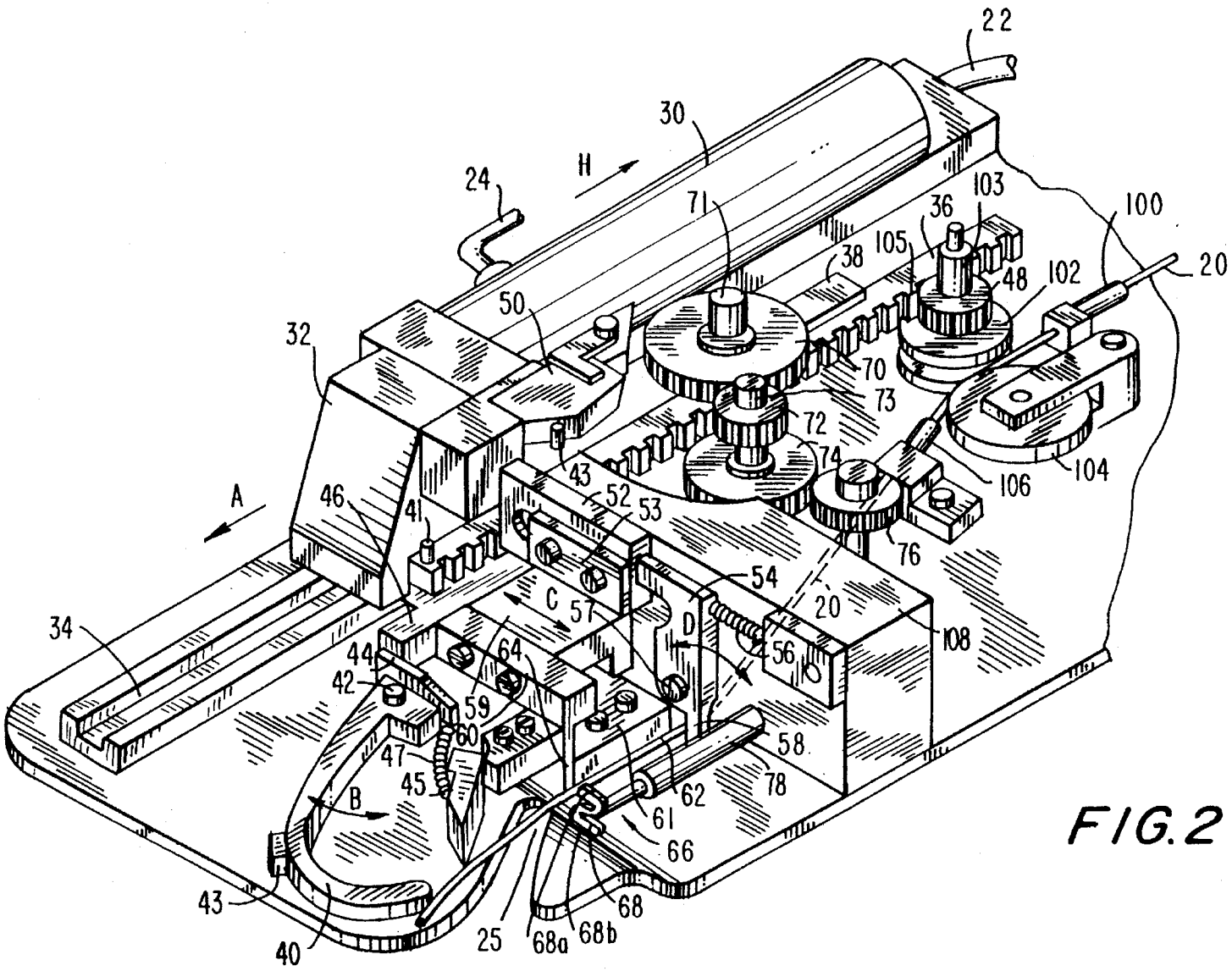
FIG. 2 is a partial perspective view of the internal construction of the twist tie device constructed in accordance with the invention.
Figure 3:
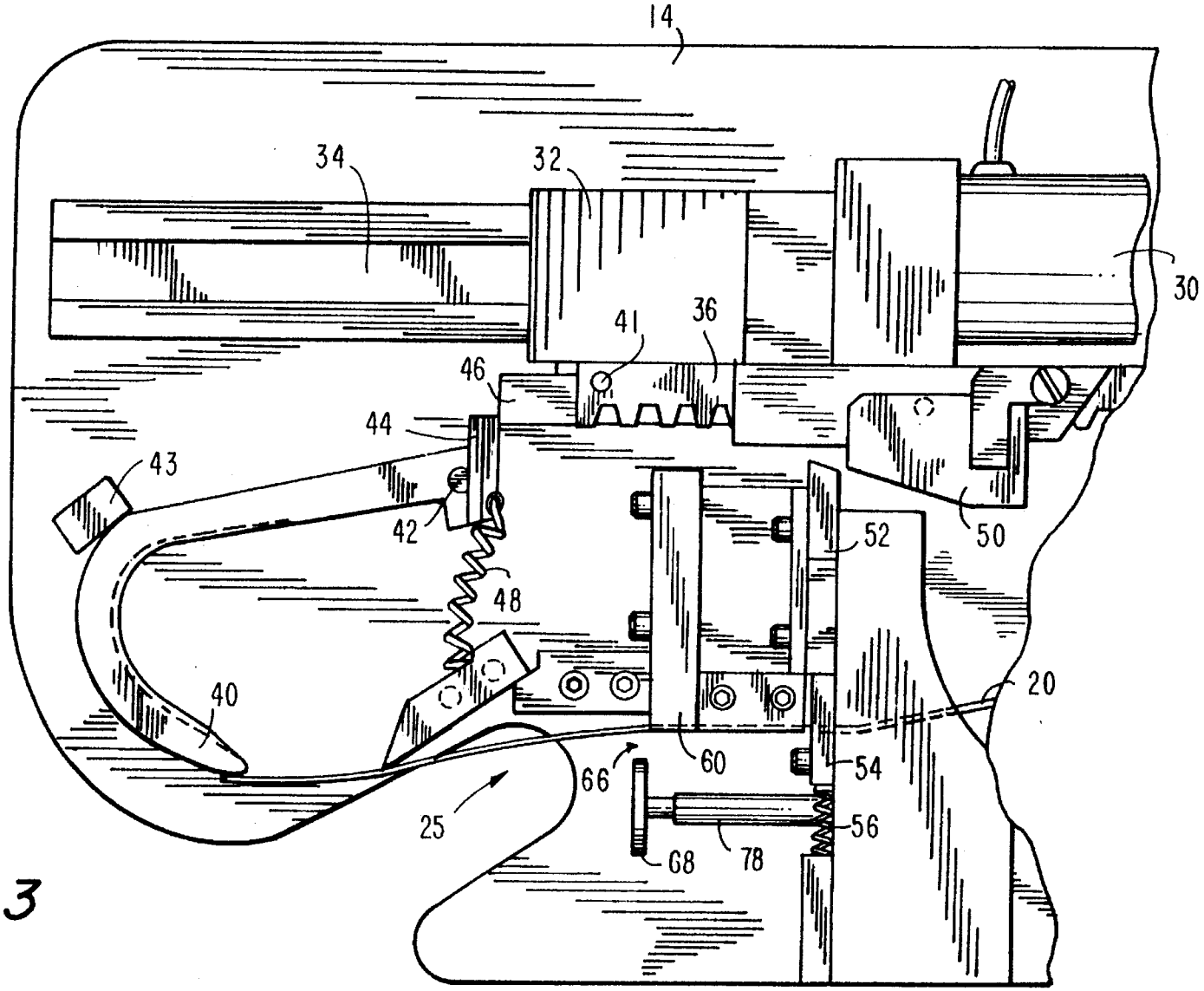
FIG. 3 is a partial top plan view of FIG. 2.
Figure 4:
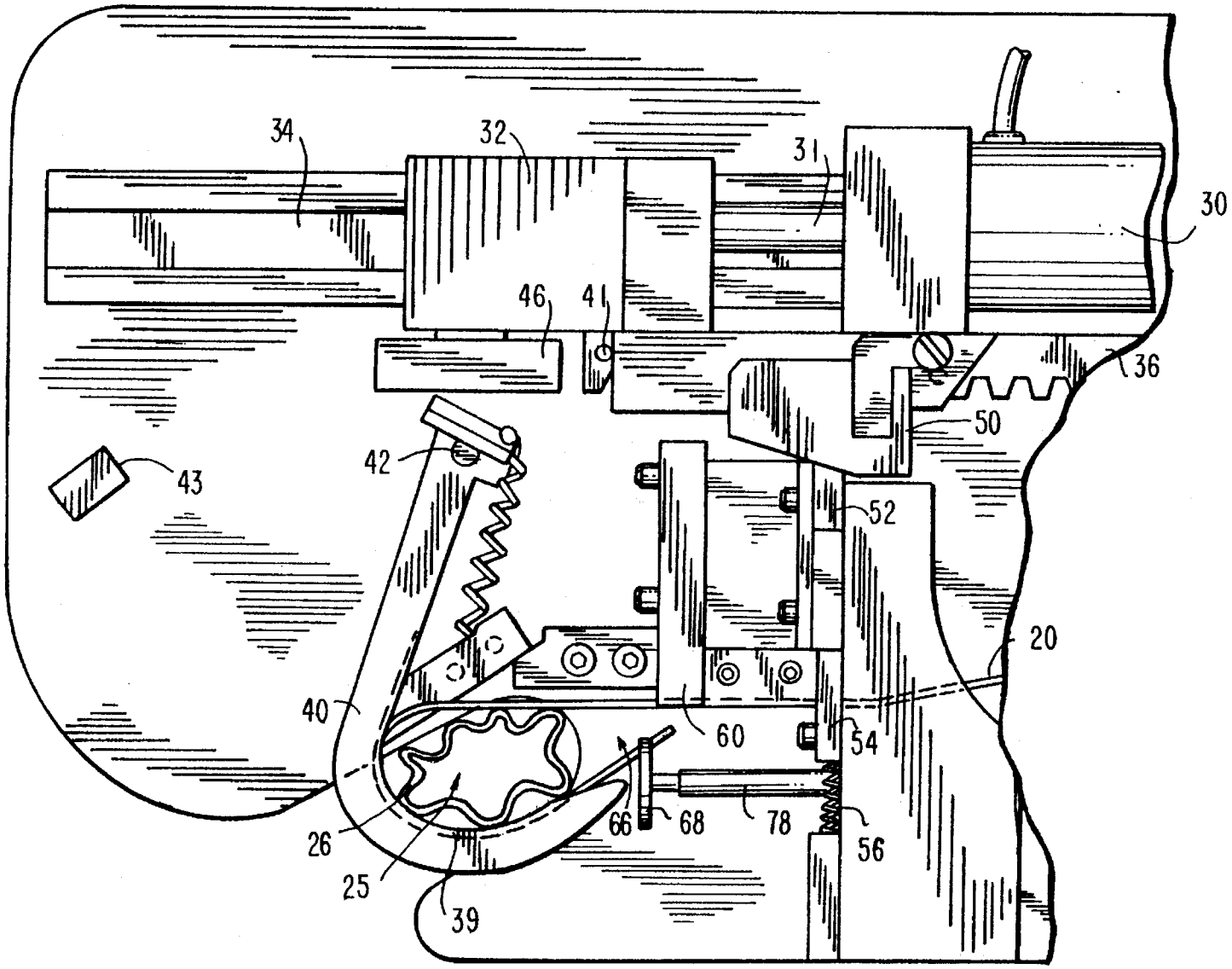
FIG. 4 is a partial top plan view of FIG. 2 of the pneumatic cylinder in the first position.

Referring specifically to FIGS. 2–5, tie ribbon 20 enters the back end of machine 10 and is inserted into a tube 100. Thereafter, it is fed between a drive wheel 102 and idler wheel 104 in facing relationship with each other. Wheel 102 engages a one way clutch 48, while wheel 104 is driven by the friction force of the movement of drive wheel 102 or ribbon 20 as it passes between wheels 102 and 104. Therefore, wheels 102 and 104 extend into tangential rolling contact with each surface of tie ribbon 20, thereby driving tie ribbon 20 by the frictional force between drive wheel 102 and ribbon 20 into a second tube 106 and through a support plate 108. Tie ribbon 20 is then fed through channel 62 of a plate 61. The free end of tie ribbon 20 continues beyond channel 62 and extends into bag receiving section 25 as best shown in FIGS. 2 and 3.

To operate machine 10, bag 26 or the like is inserted into bag receiving section 25 as essentially shown in FIG. 1 (i.e. with twist tie 28 not yet on). Button 18 is pressed creating a pneumatic signal in a manner known in the art, and initiating a tying cycle. Air is forced into cylinder 30 through tube 24 under pressure. Single pneumatic cylinder 30 has a plunger rod 31 with a head 32 attached thereto. Under pressure, rod 31 and head 32 move in a forward direction of arrow A in a direction extending into nose cover 14. A rack 36 together with a cam 46 are connected to head 32. Rack 36 is aligned with cylinder 30 and extends parallel thereto. A rack cover 38 is provided to protect rack 36.

Actuation of the control signal causes air to be input to cylinder 30 under pressure. As a result, rod 31 extends from cylinder 30. Rod 31 and head 32 begin to move along track 34 from a start position (rod 31 not extended) shown in FIG. 3 to a first position (rod 31 partially extended) shown in FIG. 4 as air from tube 22 is forced into cylinder 30 in response to the actuation of the control signal from button 18. In the preferred embodiment, the first position is approximately ½ of an inch along rack 36. Tube 22 as well as tube 24 are coupled to a standard pneumatic air pump (not shown) for creating pressure in the range of 50–75 psi. It is noted that any pressure is applicable to the present invention so long as the cylinder is designed to extend for a pressure within the selected pressure range.

Cam 46 affixed to head 32 moves with head 32. As head 32 and cam 46 are moved to the first position, defined between pins 41 and 43 mounted on rack 36, cam 46 strikes an arm tip 44 of an arm 40 rotatably mounted under nose cover 14. This motion causes arm 40 to rotate about a pivot point 42 in a first direction of arrow B so that arm 40 closes bag receiving section 25. Arm 40 is formed with a channel 39 therein so that as ribbon 20 extending into receiving section 25 comes in contact with arm 40, arm 40 guides and bends tie ribbon 20 to partially wrap around bag 26 (FIG. 3). Once head 32 is in the first position, the free end of tie ribbon 20 is now positioned in a twisting area 66 in the vicinity of a twist head 68 mounted on nose cover 14. A portion of tie ribbon 20 rests in channel 39 of arm 40. The free end of tie ribbon 20 may lie on either side of twist head 68 depending on the positioning and shape of arm 40.

A one way clutch 48 coaxially mounted on drive wheel 102 to rotate with wheel 102 in a feed direction meshes with rack 30 for feeding tie ribbon 20 into machine 10 when rack 36 moves in the direction of arrow H (FIG. 2). When rack 36 moves in the direction of arrow A, clutch 48 prevents wheels 102 and 104 from rotating and therefore from feeding tie ribbon during the extension of cylinder 30. Therefore, no tie ribbon 20 is fed through machine 10 as rod 31 and head 32 are extended into direction of the first position.

Rod 31 and head 32 continue their movement along track 34 between the first position to the second position. As these components move to the second position (FIG. 5), tie ribbon 20 is cut and placed in position for twisting or wrapping. Twisting occurs when the ends of a tie are braided together. Wrapping occurs when one end of the tie remains straight and the other end is wound about it.

In particular, a cam 50 mounted on head 32 and having a beveled leading edge, strikes an element 52 mounted for movement between support 108 and plate 53. As cam 50 strikes element 52, element 52 moves in the direction of arrow D (FIG. 2). Element 52 is coupled to a plate 59. An element 60 is in turn coupled to plate 59 so that when element 52 moves, plate 59 and element 60 move simultaneously therewith in the directions of arrow C (FIG. 2).

As element 52 begins to move, element 52 contacts a cutter lever 54 rotatably mounted on support 108 and coupled to a spring 56. Spring 56 mounted between an anchoring block 61 on support 108 and cutter lever 54 biases cutter lever 54 into a position adjacent the feed path of ribbon 28. A knife 58 is formed on cutter lever 54 and extends adjacent the feed path of ribbon 20. Movement of element 52 forces cutter lever 54 to rotate about a pivot 57 causing knife 58 to rotate across channel 62 cutting tie ribbon 20 positioned in channel 62. Thus, twist tie 28 is formed as shown, for example, in FIG. 1. In the preferred embodiment, twist tie 28 is approximately 3½ inches in length. However, its length depends on the setting of the drive feed assembly.

Simultaneously, as cam 50 strikes element 52, element 60 having a ribbon pusher 64 extending below the feed path of ribbon 28 formed thereon moves in the direction of arrow C toward twisting area 66 and twist head 68. As ribbon pusher 64 moves in the direction of twisting area 66, ribbon pusher 64 pushes tie ribbon 20 out from channel 62 and into twisting area 66 (FIG. 2).

After tie ribbon 20 is positioned in twisting area 66, the twisting process is initiated. The twisting is accomplished by the combination of a first gear, not shown, positioned below a one way clutch 70, the first gear engaging rack 36. One way clutch 70 is connected to this first gear through a rod 71 and is engaged with gear 72 and rotates therewith in one direction. Gear 72 is coaxially mounted about a shaft 73 with gear 74 and rotates simultaneously therewith. Gear 74 engages gear 76 for rotationally driving a drive rod 78 coupled to twist head 68. The translation of rotation of gear 76 into rotating drive rod 78 is done through conventional gearing as known in the prior art.

As head 32 and rack 36 continue their movement in the direction of arrow A along track 34 to the second position, rack 36 engages the first gear causing it to rotate, which in turn causes one way clutch 70 and gear 72 to rotate. Gear 72 in turn causes gear 74 to rotate, which then drives gear 76. The rotation of gear 76 drives rod 78 causing twist head 68 to rotate. In the preferred embodiment, rotation is accomplished at a 4:1 gear ratio. However, any number of different gearing ratios are acceptable as well as any gear combination.

Figure 5:
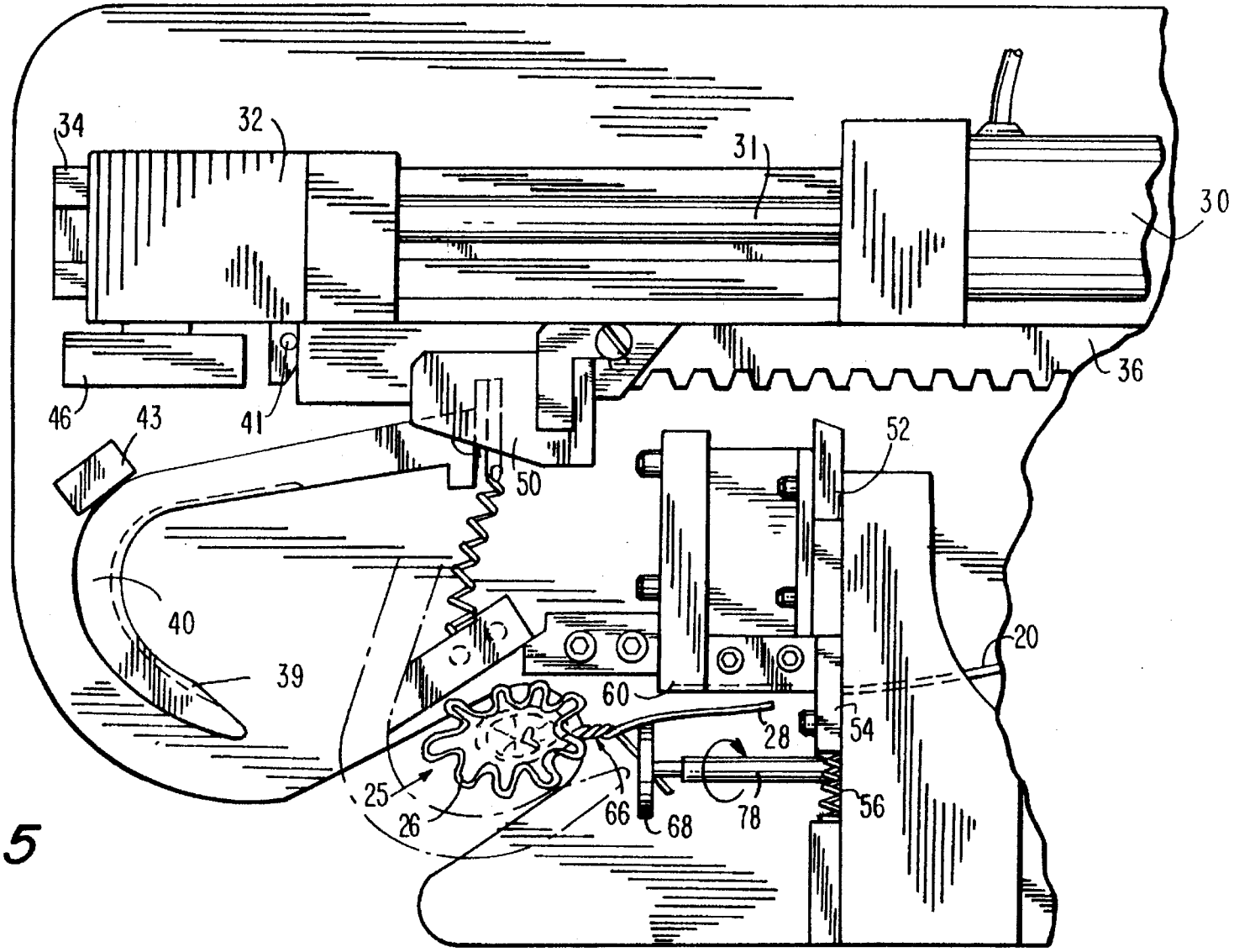
FIG. 5 is a partial top plan view of FIG. 2 of the pneumatic cylinder in the second position taken along line 5—5 of FIG. 1.

Twist head 68 is S-shaped and therefore includes two distinct hook shaped sections 68*a*, 68*b* for receiving twist tie 28. As twist head 68 begins to rotate, it captures one of the two free ends of twist tie 28 in hook shaped section 68*a*. As twist head 68 continues its rotation, section 68*b* of twist head 68 captures the second free end of twist tie 28. The continued rotation at the predetermined gear ratio causes the two ends of the twist tie to twist around one another tightening ribbon 28 about bag 26 so as to seal bag 26 or the like as shown in FIGS. 1 and 5. Alternatively, the device may be configured so that only one end of twist tie 28 is captured by twist head 68 so that the twist tie is wrapped instead of twisted.

Rack 36 reaches the second position as shown in FIG. 5 at the end of track 34, completing movement of head 32 in the direction of arrow A. Arm 40 is coupled to a block 45 by a spring 47, which biases arm 40 in an open position away from receiving section 25. As rack 36 reaches the end of its travel, cam 46, which held arm 40 in the closed position, is moved past arm tip 44. This causes arm 40 to return to its original position based on the return energy of spring 47. Arm 40 is stopped at its original position by means of a stopper 43. At essentially the same time, cutter lever 54 and ribbon pusher 64 are returned to their original position by the biasing force of spring 56.

At the second position, cylinder 30 is fully extended along rack 36, thereby completing the twisting cycle. A second pneumatic signal is actuated by means of button 18 to begin the retraction of cylinder 30. In the preferred embodiment, head 32 moves along track 34 approximately ½ of an inch as air from air tube 24 forces rod 31 to return into cylinder 30. The twist tied bag may then be removed from bag receiving section 25. In an alternative embodiment, button 18 may be positioned in bag receiving section 25 so that as the bag is removed it actuates the button so as to initiate the retraction steps of the cylinder.

As rod 31 begins retraction into cylinder 30, one way clutch 70 does not rotate preventing the gearing arrangement to rotate rod 78 and twist head 68. However, the retraction causes rack 36 to engage and rotate one way clutch 48. Thus, drive wheel 102 rotates to feed tie ribbon through the ribbon feed path for the next twist cycle. As rod 31 retracts, ribbon 28 is fed to receiving section 25 to be in place for the next tying operation. In addition, cams 46 and 50 are bevelled at their respective trailing edges so that they pass over arm tip 44 and element 52 and do not inadvertently cause arm 40, cutter lever 54 or ribbon pusher 64 to move during the retraction of rod 31 and head 32 as will be described in greater below. Therefore, tie ribbon 20 may be fed into machine 10 without any interference.

Figure 6:
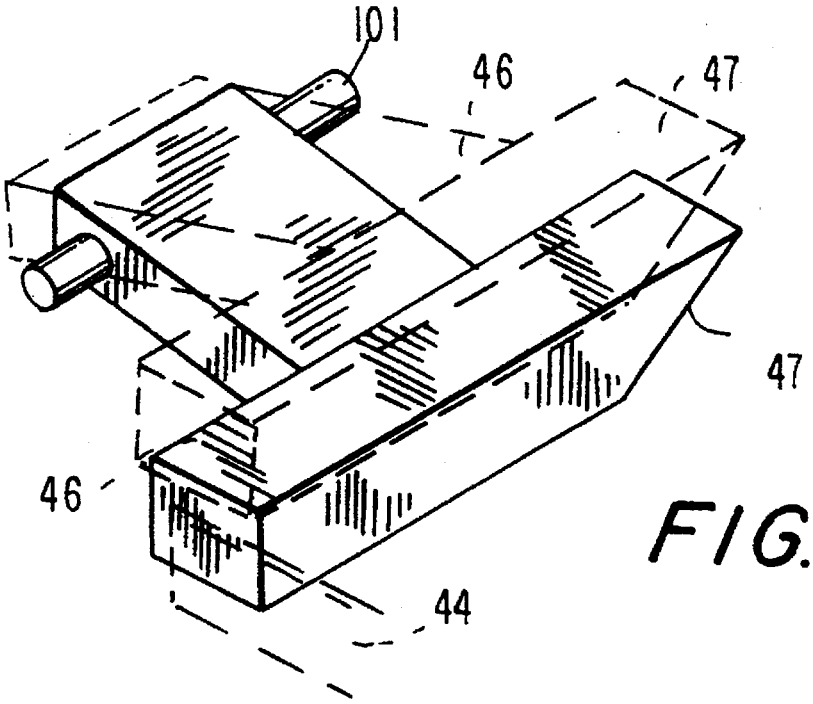
FIG. 6 is an enlarged perspective view of a first cam in accordance with the invention.

Referring specifically to FIGS. 5 and 6, cam 46 is formed with a beveled tip 47. Cam 46 is pivotably mounted on head 32 about a shaft 101. Therefore, as head 32 is being retracted, cam 46 pivots about shaft 101 upward and over arm tip 44 as shown in phantom in FIG. 6. In other words, as beveled tip 47 of cam 46 makes contact with arm tip 44, cam 44 is forced up and over arm tip 44.

Figure 7:
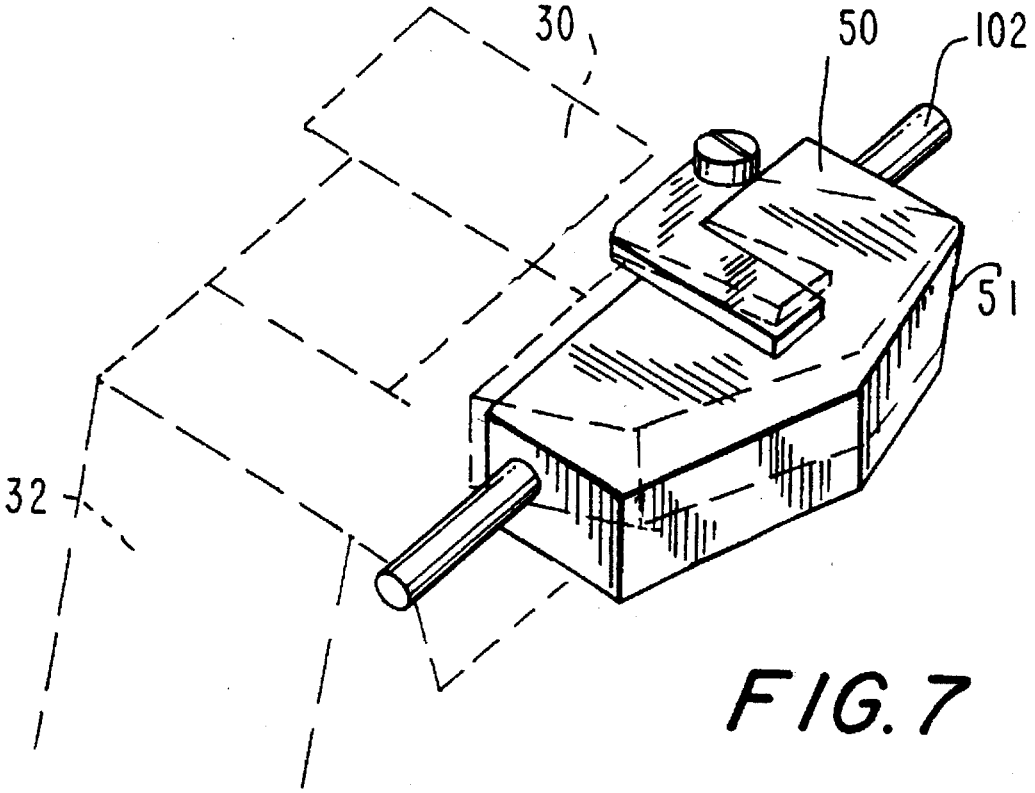
FIG. 7 is an enlarged perspective view of a second cam in accordance with the invention.

Similarly, referring to FIGS. 2 and 7, cam 50 also includes a beveled tip 51. Cam 50 is pivotably mounted about a shaft 102 on head 32. As cylinder 30 continues to retract, beveled tip 51 of cam 50 strikes element 52 causing cam 50 to move up and over element 52 so that ribbon pusher 64 and cutter lever 54 are not moved as shown in phantom in FIG. 7. Upon completion of the retraction process, tie ribbon 20 is in position as shown in FIG. 2 and machine 10 is ready for the next twisting cycle.

As can now be readily appreciated, a small hand held twist tie machine is provided. In an exemplary embodiment, by limiting the construction to a single cylinder, machine 10 may be as small as approximately 2 inches high by 4 inches wide by 9 inches long and weigh approximately 3½ pounds. The device may be hand held so as to have applications in tough to reach spots such as a bag in a box or a drum. Alternatively, the machine could be bench mounted or mounted above an assembly line though various brackets.

Because the device may be formed from any combination of stainless steel, aluminum and plastics, the device may withstand most forms of cleaning including steam cleaning that meet today's food packaging standards. In addition, it may be used in all types of environments without concern of jams, clogs or the like.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A twist tie device for twisting together the ends of a tie ribbon encircling an article which is positioned therein for tying, comprising:

feed means for feeding the tie ribbon in the device to the article;

arm means for guiding the tie ribbon around the article;

twist means for tightening the tie ribbon around the article;

gear means coupled to said twist means for driving said twist means and said feed means for feeding said tie ribbon; and actuator means coupled to said gear means, said actuator means responsive to a control signal causing said actuator means to move in a first direction between a start position, a first position and a second position, said actuator means moving from said start position to a first position and making contact with said arm means as said actuator means moves to said first position to position said arm means to partially guide the tie ribbon around the article, said actuator means moving between said first position and said second position and driving said gear means as said actuator means moves to said second position causing said twist means to tighten the tie ribbon around the article, said actuator means returning to said start position and driving said gear means causing said feed means to feed said tie ribbon in the device to the article as said actuator means moves to said start position.

2. The twist tie device of claim 1, and further including cutting means rotatably mounted for cutting said tie ribbon, said actuator means making contact with said cutting means as said actuating means moves from said first position to said second position to rotate said cutting means to cut the tie ribbon.

3. The twist tie device of claim 2, wherein said actuator means includes a pneumatic cylinder and plunger rod.

4. The twist tie device of claim 3, wherein said plunger rod includes a head disposed at the end thereof and rack means for engaging said gear means and said feed means, said rack means extending essentially parallel to said rod.

5. The twist tie device of claim 4, wherein said gear means includes a plurality of gears operatively coupling said rack means to said feed means and said twist means.

6. The twist tie device of claim 5, wherein said gear means includes a first one way clutch so that when said actuator means returns to said start position said plurality of gears do not drive said twist means.

7. The twist tie device of claim 6, wherein said gear means includes a second one way clutch engaging said rack means so that when said actuator means moves from said start position to said first position and from said first position to said second position said feed means does not feed tie ribbon in said device.

8. The twist tie device of claim 7, wherein said feed means includes a feed wheel and idler wheel, each extending in tangential rolling contact with the tie ribbon for driving the tie ribbon through the device.

9. The twist tie device of claim 8, wherein said head further includes a first cam means for contacting said arm means and moving said arm means to partially wrap the tie ribbon around the article as said actuator means moves from said start position to said first position.

10. The twist tie device of claim 9, wherein said first cam means is pivotable mounted to said head, said first cam means pivoting over said arm means when said actuator means moves from said second position to said start position so that said arm means does not inadvertently move.

11. The twist tie device of claim 10, wherein said head includes a second cam means for contacting said cutter means causing said cutter means to cut said tie ribbon as said actuator means moves from said first position to said second position.

12. The twist tie device of claim 11, wherein said second cam means is pivotable, said second cam means pivoting over said cutter means when said actuator means moves from said second position to said start position so that said cutter means does not inadvertently cut said tie ribbon.

13. The twist tie device of claim 4, wherein said head further includes a first cam means for contacting said arm means and moving said arm means to partially wrap the tie ribbon around the article as said actuator moves from said start position to said first position.

14. The twist tie device of claim 13, wherein said first cam means is pivotable mounted to said head, said first cam means pivoting over said arm means when said actuator means moves from said second position to said start position so that said arm means does not inadvertently move.

15. The twist tie device of claim 4, wherein said head includes a second cam means for contacting said cutter means causing said cutter means to cut said tie ribbon as said actuator means moves from said first position to said second position.

16. The twist tie device of claim 15, wherein said second cam means is pivotable, said second cam means pivoting over said cutter means when said actuator means moves from said second position to said start position so that said cutter means does not inadvertently cut said tie ribbon.

17. The twist tie device of claim 2, wherein a second actuator control signal causes said actuator to move from said second position to said start position.

* * * * *